US009715218B2

(12) United States Patent
Ashkenazi

(10) Patent No.: US 9,715,218 B2
(45) Date of Patent: Jul. 25, 2017

(54) SYSTEMS AND METHODS FOR DIMMING AN ALARM CLOCK WITH THREE DISPLAYS

(71) Applicant: HTI Industries LLC, Rahway, NJ (US)

(72) Inventor: Ely I. Ashkenazi, Rahway, NJ (US)

(73) Assignee: HTI INDUSTRIES LLC, Rahway, NJ (US)

( * ) Notice: Subject to any disclaimer, the term of this patent is extended or adjusted under 35 U.S.C. 154(b) by 0 days.

(21) Appl. No.: 15/178,257

(22) Filed: Jun. 9, 2016

(65) Prior Publication Data

US 2016/0363912 A1 Dec. 15, 2016

Related U.S. Application Data

(60) Provisional application No. 62/173,488, filed on Jun. 10, 2015.

(51) Int. Cl.

| | |
|---|---|
| ***G04G 9/00*** | (2006.01) |
| ***G04G 9/08*** | (2006.01) |
| ***G04G 9/10*** | (2006.01) |
| ***G04G 9/12*** | (2006.01) |
| ***G04G 17/08*** | (2006.01) |

(52) U.S. Cl.

CPC ..... *G04G 9/08* (2013.01); *G04G 9/0041* (2013.01); *G04G 9/10* (2013.01); *G04G 9/12* (2013.01); *G04G 17/086* (2013.01)

(58) Field of Classification Search

CPC ..... G04G 9/0041; G04G 9/08; G04G 9/10; G04G 9/12; G04G 17/086

See application file for complete search history.

(56) References Cited

U.S. PATENT DOCUMENTS 3,106,817 A * 10/1963 Ducommun ..... G04B 19/025 368/316
3,284,667 A 11/1966 Harris et al.
4,720,820 A * 1/1988 Siefert ..... G04B 45/0053 368/223
4,888,748 A * 12/1989 Lagasse ..... G04B 37/0066 368/107

(Continued)

FOREIGN PATENT DOCUMENTS

CN 101763023 A 6/2010

*Primary Examiner* — Vit W Miska
(74) *Attorney, Agent, or Firm* — Foley & Lardner LLP; Christopher J. McKenna

(57) ABSTRACT

The disclosure is directed towards systems and methods for dimming an alarm clock with three displays. An alarm clock can include three displays each positioned on a different side of the alarm clock to allow the alarm clock to be read from different vantage points. In some implementations, the alarm clock can include a front display, a right side display, and a left side display. Each display can have multiple brightness settings. Each display also can have a respective dimming button to allow a user to select a desired brightness level. In some implementations, the dimming button for the front display can serve as a master dimming button by controlling the brightness of all three of the displays, while the right side dimming button and the left side dimming button control only the brightness setting for the right side display and the left side display, respectively.

21 Claims, 4 Drawing Sheets

(56) References Cited

U.S. PATENT DOCUMENTS

| | | | | | |
|---|---|---|---|---|---|
| 5,377,171 | A | * | 12/1994 | Schlup | G04B 5/18 368/140 |
| D360,368 | S | | 7/1995 | Pickett et al. | |
| D452,164 | S | * | 12/2001 | Buss | D10/1 |
| D460,361 | S | * | 7/2002 | Hazen | D10/14 |
| 7,693,009 | B2 | * | 4/2010 | Buss | G04G 9/12 368/82 |
| 2010/0277081 | A1 | | 11/2010 | Feng | |
| 2011/0267929 | A1 | * | 11/2011 | Ishakis | G04G 17/086 368/228 |

* cited by examiner

SYSTEMS AND METHODS FOR DIMMING AN ALARM CLOCK WITH THREE DISPLAYS

RELATED APPLICATIONS

This application claims priority to U.S. Provisional Application No. 62/173,488, filed on Jun. 10, 2015, and entitled "Systems and Methods for Dimming an Alarm Clock with Three Displays," the entire contents of which are incorporated by reference herein.

BACKGROUND

Digital clocks can be used to display current time, set alarms, and play music. Some digital clocks include a display incorporating a backlight or other light-emitting technology to allow the display to be read in an environment with a low ambient light level.

BRIEF SUMMARY

Aspects and implementations of the present disclosure are directed to systems and methods for dimming an alarm clock with three displays. An alarm clock can include three displays each positioned on a different side of the alarm clock to allow the alarm clock to be read from different vantage points. For example, in some implementations, an alarm clock can include a front display, a right side display, and a left side display. As a result, a person can read the current time from a wide range of perspectives, without the need for a direct line of sight to the front display. In some implementations, each of the three displays can show the same information, such as the current time. In some other implementations, the front display can serve as a primary display and may include additional information, such as the time for which an alarm is set, and the right and left side displays may show only a subset of the information shown on the front display.

In some implementations, each of the three displays can be a light emitting diode (LED) display, so that each display can be read in the dark. In some other implementations, each display can be a liquid crystal display (LCD) including a backlight to allow the displays to be read in the dark. Each display can have multiple brightness settings. For example, each display may have 2, 3, 4, or more different brightness settings, and a user can adjust the brightness of each display based on ambient light levels and user preferences. Each display may have a respective dimming button or other input device to allow a user to select a desired brightness level. In some implementations, the dimming button for the front display can serve as a master dimming button by controlling the brightness of all three of the displays. The dimming buttons for each of the right side display and the left side display can be configured to control only the brightness level of their respective display. Thus, pressing the dimming button for the right side display can cause the brightness of the right side display to cycle through each of its available brightness levels without adjusting the brightness of either the front display or the left side display. Similarly, pressing the dimming button for the left side display can cause the brightness of the left side display to cycle through each of its available brightness levels without adjusting the brightness of either the front display or the right side display. Pressing the dimming button for the front display can cause the brightness of the front display, the right side display, and the left side display to all cycle through the available brightness levels simultaneously.

In one aspect, the disclosure is directed to a multi-display clock. The multi-display clock can include a front display on a front face of a housing of a clock to display a time, a left side display to display the time on a left face of the housing positioned between about 30 degrees to about 120 degrees to the left of an orientation of the front display, and a right side display to display the time on a right face of the housing positioned between about 30 degrees to about 120 degrees to the right of the orientation of the front display. The multi-display clock can include a front dimming input device configured to receive input to control dimming of each of the front display, the left side display, and the right side display. The multi-display clock can include a left dimming input device configured to receive input to control dimming of the left side display. The multi-display clock can include a right dimming input device configured to receive input to control dimming of the right side display. The multi-display clock also can include a controller configured to adjust a brightness level of each of the front display, the left side display, and the right side display, responsive to receiving an input signal from at least one of the front dimming input device, the left dimming input device or the right dimming input device.

In some implementations, at least one of the front display, the left side display, and the right side display can include a light-emitting diode (LED) display. The controller can be further configured to adjust a light output associated with the LEDs of the LED display, responsive to receiving the input signal from the front dimming input device. In some other implementations, at least one of the front display, the left side display, and the right side display can include a liquid crystal display (LCD) and a backlight. The controller can be further configured to adjust a light output associated with the backlight of the LCD, responsive to receiving the input signal from the front dimming input device. In some implementations, the controller can be further configured to adjust a brightness level of only the left side display, responsive to receiving an input signal from the left side dimming input device, and to adjust a brightness level of only the right side display, responsive to receiving an input signal from the right side dimming input device.

In some implementations, each of the front display, the left side display, and the right side display is configured to display information at a plurality of brightness levels. The controller can be further configured to toggle through the brightness levels of the left side display in order from least bright to most bright, responsive to receiving the input signal from the left side dimming input device. The controller also can be configured to toggle through the brightness levels of the right side display in order from least bright to most bright, responsive to receiving the input signal from the right side dimming input device. The controller also can be configured to toggle through the brightness levels of the front display, the left side display, and the right side display in order from least bright to most bright, responsive to receiving the input signal from the front dimming input device.

In some other implementations, each of the front display, the left side display, and the right side display can be configured to display information at a plurality of brightness levels. The controller can be further configured to toggle through the brightness levels of the left side display in order from most bright to least bright, responsive to receiving the input signal from the left side dimming input device. The controller also can be configured to toggle through the brightness levels of the right side display in order from most bright to least bright, responsive to receiving the input signal from the right side dimming input device. The controller also can be configured to toggle through the brightness levels of the front display, the left side display, and the right side display in order from most bright to least bright, responsive to receiving the input signal from the front dimming input device.

In some implementations, the controller can be further configured to cause each of the front display, the left side display, and the right side display to display first information, and to cause the front display to concurrently display second information along with the first information. The second information can be different from the first information. In some implementations, the first information can include a current time. In some implementations, the second information can include a time for which an alarm is set. The controller can be further configured to cause the multi-display clock to sound the alarm when the current time matches the time for which the alarm is set. In some implementations, the multi-display clock also can include an alarm adjust input device configured to receive input to control the time for which the alarm is set. The controller can be further configured to adjust the time for which the alarm is set, responsive to receiving an input signal from the alarm adjustment input device.

In some implementations, the multi-display clock can include at least one universal serial bus (USB) port communicatively coupled to the controller. In some implementations, the front face of the housing further comprises a substantially transparent cover positioned over the front display. In some implementations, at least one of the left face of the housing and the right face of the housing can include a substantially opaque portion. At least one of the left side display and the right side display can be configured to be visible through the substantially opaque portion of the housing.

In another aspect, the disclosure is directed to a method for using a multi-display clock. The method can include providing a multi-display clock including a front display on a front face of a housing of a clock to display a time, a left side display to display the time on a left face of the housing positioned between about 30 degrees to about 120 degrees to the left of an orientation of the front display, and a right side display to display the time on a right face of the housing positioned between about 30 degrees to about 120 degrees to the right of the orientation of the front display. The multi-display clock also can include a front dimming input device configured to receive input to control dimming of each of the front display, the left side display, and the right side display. The multi-display clock also can include a left dimming input device configured to receive input to control dimming of the left side display. The multi-display clock also can include a right dimming input device configured to receive input to control dimming of the right side display. The method can include receiving, by a controller of the multi-display clock, an input signal from one of the front dimming input device, the left dimming input device, and the right input dimming device. The method also can include adjusting, by the controller, a brightness level of at least one of the front display, the left side display, and the right side display of the multi-display clock, responsive to receiving the input signal.

In some implementations, at least one of the front display, the left side display, and the right side display can include a light-emitting diode (LED) display. The method can further include adjusting, by the controller, a light output associated with the LEDs of the LED display, responsive to receiving the input signal from the front dimming input device. In some other implementations, at least one of the front display, the left side display, and the right side display can include a liquid crystal display (LCD) and a backlight. The method can further include adjusting, by the controller, a light output associated with the backlight of the LCD, responsive to receiving the input signal from the front dimming input device.

In some implementations, the method can include receiving, by the controller, the input signal from the left side dimming input device, and adjusting, by the controller, a brightness level of only the left side display, responsive to receiving the input signal from the left side dimming input device. In some implementations, the method can include receiving, by the controller, the input signal from the right side dimming input device. The method also can include adjusting, by the controller, a brightness level of only the right side display, responsive to receiving the input signal from the right side dimming input device.

In some implementations, each of the front display, the left side display, and the right side display can be configured to display information at a plurality of brightness levels. The method can further include toggling, by the controller, through the brightness levels of the left side display in order from least bright to most bright, responsive to receiving the input signal from the left side dimming input device. The method also can include toggling, by the controller, through the brightness levels of the right side display in order from least bright to most bright, responsive to receiving the input signal from the right side dimming input device. The method also can include toggling, by the controller, through the brightness levels of the front display, the left side display, and the right side display in order from least bright to most bright, responsive to receiving the input signal from the front dimming input device.

In some other implementations, each of the front display, the left side display, and the right side display is configured to display information at a plurality of brightness levels, and the method can further include toggling, by the controller, through the brightness levels of the left side display in order from most bright to least bright, responsive to receiving the input signal from the left side dimming input device. The method also can include toggling, by the controller, through the brightness levels of the right side display in order from most bright to least bright, responsive to receiving the input signal from the right side dimming input device. The method also can include toggling, by the controller, through the brightness levels of the front display, the left side display, and the right side display in order from most bright to least bright, responsive to receiving the input signal from the front dimming input device.

In some implementations, the multi-display clock can further include an alarm adjustment input device configured to receive input to control a time for which an alarm is set. The method can further include receiving, by the controller, an input signal from the alarm adjustment input device, and adjusting, by the controller, the time for which the alarm is set, responsive to receiving the input signal from the alarm adjustment input device.

The details of various embodiments of the invention are set forth in the accompanying drawings and the description below.

BRIEF DESCRIPTION OF THE FIGURES

The foregoing and other objects, aspects, features, and advantages of the invention will become more apparent and better understood by referring to the following description taken in conjunction with the accompanying drawings, in which.

Figure 1A:
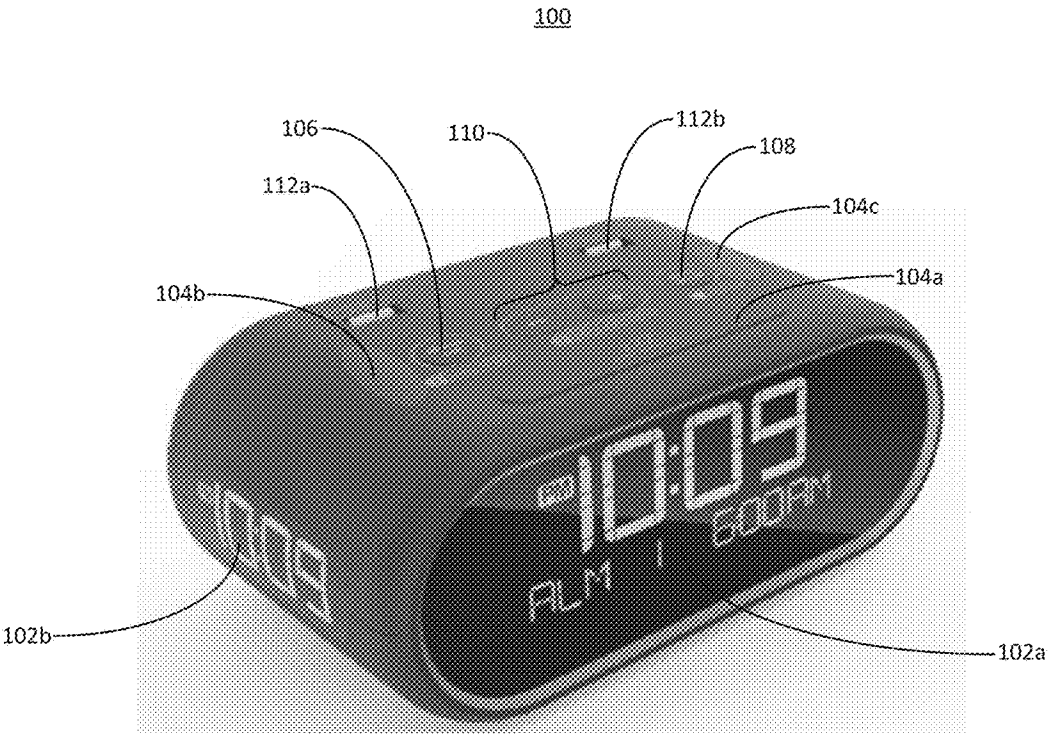
FIG. 1A shows a perspective view of an alarm clock with three displays, according to an illustrative implementation.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

Figure 1B:
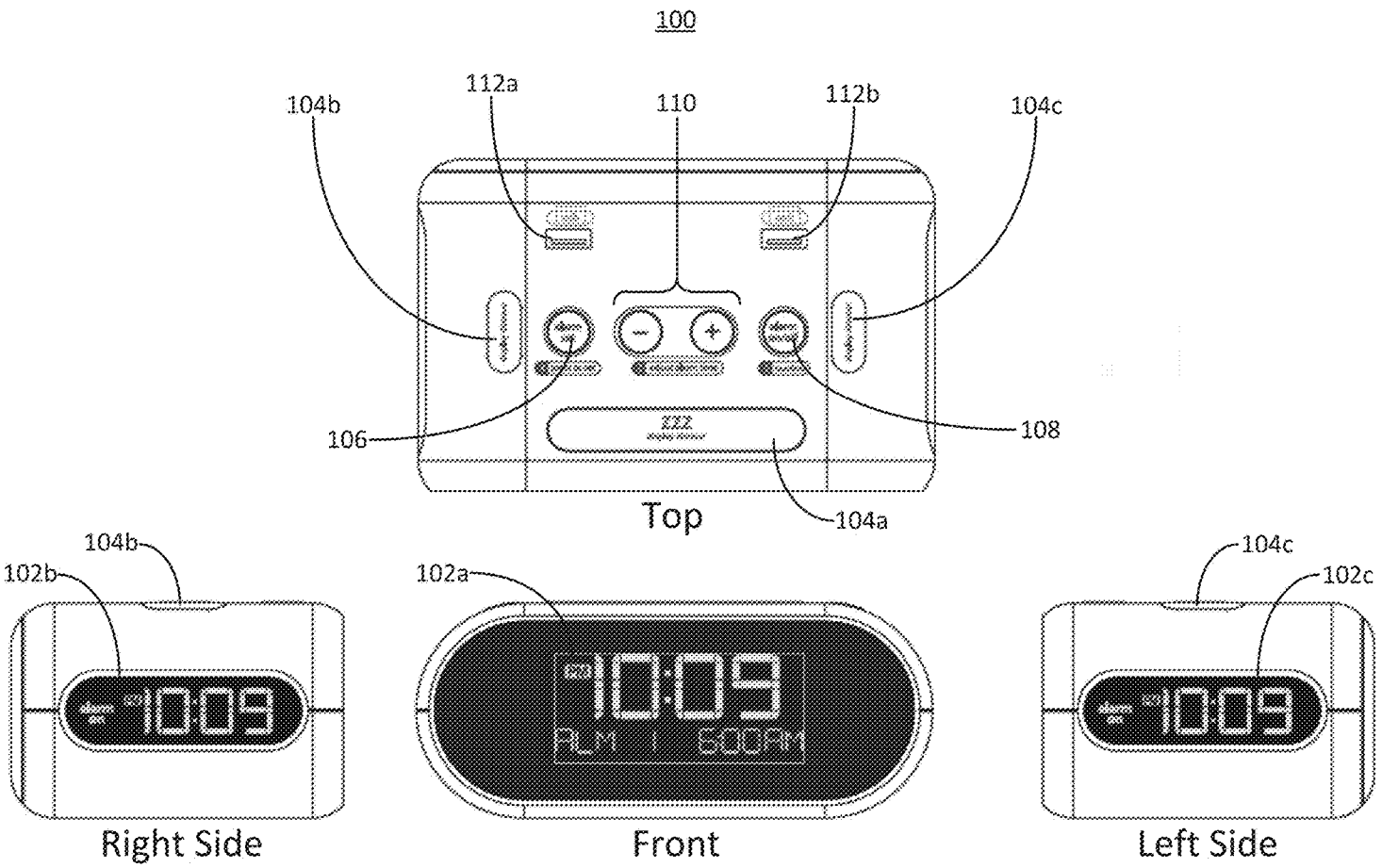
FIG. 1B shows top, front, right side, and left side views of the alarm clock with three displays shown in FIG. 1A, according to an illustrative implementation.

Aspects and implementations of the present disclosure are directed to systems and methods for dimming an alarm clock with three displays. FIG. 1A shows a perspective view of an alarm clock 100 with three displays, according to an illustrative implementation. FIG. 1B shows top, front, right side, and left side views of the alarm clock 100 with three displays shown in FIG. 1A, according to an illustrative implementations. Referring to both FIG. 1A and FIG. 1B, the alarm clock 100 includes a front display 102*a*, a left side display 102*b*, and a right side display 102*c* (generally referred to as displays 102). The alarm clock 100 includes a front dimming button 104*a*, a left side dimming button 104*b*, and a right side dimming button 104*c*, corresponding to the front display 102*a*, a left side display 102*b*, and a right side display 102*c*, respectively. The alarm clock 100 also includes an alarm set button 106, and alarm on/off button 108, an alarm adjustment button 110, and two universal serial bus (USB) ports 112*a* and 112*b*.

The front display 102*a* is larger and displays more information than either of the left side display 102*b* or the right side display 102*c*. For example, while all of the displays 102 show the current time, the front display 102*a* additionally includes the time for which an alarm is set. In some implementations, the front display 102*a* may be considered as the primary display of the alarm clock 100, and the left side display 102*b* and right side display 102*c* may be considered as secondary displays. In general, the front display 102*a*, the left side display 102*b*, and the right side display 102*c* may all be configured to display first information, such as the current time as shown in FIG. 1A. The front display 102*a* also may be configured to display second information concurrently with the first information. In the example of FIG. 1A, the second information includes the time for which the alarm is set. In some other implementations, the first information and the second information may include other types of information, such as a selected radio station or a selected type of audio input.

The displays 102 include LEDs positioned against a dark background, allowing the displays 102 to be read in low light conditions. In some other implementations, the displays 102 can include LCD displays having respective backlights to make the displays 102 visible in low light conditions. The brightness of each display 102 can be adjustable. For example, the brightness of the displays 102 can be reduced by reducing the amount of current passing through the LEDs that form the displays 102. In some implementations, a pulse width modulation (PWM) scheme can be used to control the brightness of the displays 102. For example, a voltage applied to a respective backlight associated with each of the displays 102 can be represented by a square wave having an adjustable duty cycle. In some implementations, the duty cycle of the voltage applied to one of the displays 102 can be increased in order to increase the brightness of the display. The cycle can be, for example, about 10%, about 20%, about 30%, about 40%, about 50%, about 60%, about 70%, about 80%, about 90%, or about 100%, depending on the desired brightness level. In some implementations, each display may have two, three, four, five, or more brightness settings.

The components of the alarm clock 100 are positioned within a housing. Portions of the housing, such as those that are positioned over the left side display 102*b* and the right side display 102*c*, are substantially opaque. Thus, in some implementations, the information displayed by the left side display 102*b* and the right side display 102*c* may be obscured when the left side display 102*b* and the right side display 102*c* are below a certain brightness level. However, with a sufficient brightness level, the information displayed by the left side display 102*b* and the right side display 102*c* can be seen through the opaque portions of the housing, as illustrated in FIG. 1A. Other portions of the housing may be substantially transparent, such as the transparent cover positioned in front of the front display 102*a*.

In some implementations, the brightness of each display 102 may be individually adjustable. For example, the front display 102*a* could be set to a first brightness level, the left side display 102*b* could be set to a second brightness level, and the right side display 102*c* could be set to a third brightness level. In some implementations, the brightness of each display 102 can be adjusted using the respective dimming buttons 104. For example, pressing the front dimming button 104*a* can adjust the brightness of the front display 102*a*, pressing the left dimming button 104*b* can adjust the brightness of the left side display 102*b*, and pressing the right dimming button 104*c* can adjust the brightness of the right side display 102*c*. In some implementations, pressing one of the dimming buttons 104 can cause brightness of the corresponding display 102 to change to a different level. In some implementations, the brightness level for a display 102 can be toggled in order from least bright to most bright by pressing the corresponding dimming button 104. For example, a display 102 may initially start in its brightest state. Pressing the corresponding dimming button 104 can cause the brightness of the display 102 to decrease to the second brightest state. Similarly, a subsequent press of the button 104 can increase the brightness of the display 102 to decrease to the third brightest state, and so on. When the display 102 is in its least bright state, pressing the button 102 can cause the display 102 to return to its original brightness. In some implementations, the display 102 may initially start in its least bright state, and pressing the corresponding button 104 can cause the display 102 to increase in brightness.

In some implementations, pressing one of the buttons 104 can affect only the brightness of its corresponding display 102. For example, the left dimming button 104*b* can be used to adjust the brightness of the left side display 102*b* without changing the brightness of the front display 102*a* or the right side display 102*c*. Similarly, the right dimming button 104*c* can be used to adjust the brightness of the right side display

102*c* without changing the brightness of the front display 102*a* or the left side display 102*b*. In some implementations, the front dimming button 104*a* can serve as a master dimming button, by simultaneously adjusting the brightness of the front display 102*a*, the left side display 102*b*, and the right side display 102*c*. For example, the brightness of the front display 102*a* can be set using the front dimming button 104*a* in a manner similar to that described above. However, the front button 104*a* also can simultaneously adjust the brightness of the left side display 102*b* and the right side display 102*c* to match the brightness of the front display 102*a*. Thus, pressing the front dimming button 102*a* may cause all of the displays 102 to transition to the same brightness level. Subsequent presses of the front dimming button 104*a* can cause all of the displays 102 to transition to the next available brightness. In order to adjust the brightness of the left side display 102*b* or the right side display 102*c* independently, the respective dimming buttons (i.e., the left dimming button 104*b* or the right dimming button 104*c*) can be used as described above.

It should be understood that the general shape of the alarm clock 100 shown in FIG. 1A is illustrative only. For example, in some implementations, the alarm clock 100 may have a different shape than that illustrated in the figure. In some implementations, the left side display 102*b* and the right side display 102*c* may be oriented at different angles with respect to the front display 102*a*. For example, in some implementations, the left side display 102*b* may be positioned at an angle between about 30 degrees and about 120 degrees to the left of the orientation of the front display 102*a*. Similarly, the right side display 102*c* may be positioned at an angle between about 30 degrees and about 120 degrees to the right of the orientation of the front display 102*a*. In other implementations, the left side display 102*b* may be oriented at an angle of about 90 degrees to the left of the front display 102*a* and the right side display 102*c* may be oriented at an angle of about 90 degrees to the right of the front display 102*a*.

Figure 2A:
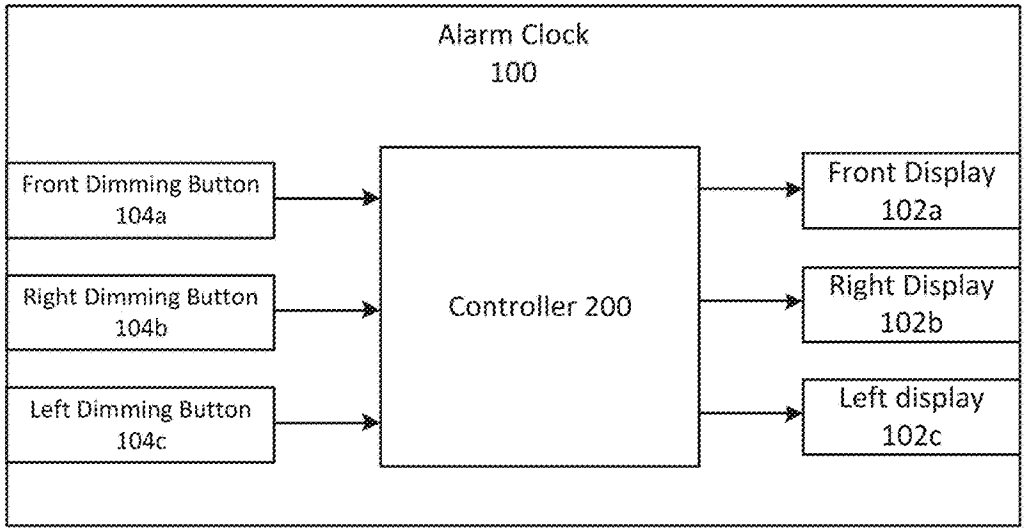
FIG. 2A is a block diagram of a controller configured to adjust the brightness of an alarm clock with three displays, according to an illustrative implementation.

FIG. 2A is a block diagram of a controller 200 configured to adjust the brightness of an alarm clock with three displays, according to an illustrative implementation. As shown, the controller 200 is positioned within the alarm clock 100 shown in FIGS. 1A and 1B. The controller is configured to receive input signals from the front dimming button 104*a*, the left dimming button 104*b*, and the right dimming button 104*c*. The controller 200 also is configured to transmit signals to the front display 104*a*, the left side display 104*b*, and the right side display 104*c*.

In some implementations, the controller 200 can be general purpose processor. In some other implementations, the controller 200 can be an application-specific integrated circuit (ASIC) or a field programmable gate array (FPGA). In some implementations, the controller 200 may be implemented as software, hardware, or a combination of software and hardware.

The signals transmitted to the controller 200 can correspond to user interaction with the dimming buttons 104. For example, the controller 200 can be configured to receive an indication from each dimming button 104 when a respective button press occurs. The signals transmitted to the displays 102 from the controller 200 can be control signals configured to adjust the brightness of each respective display 102. For example, in some implementations, the controller 200 can send a control signal to a display 102 that causes the display 102 to change its brightness level by applying a different amount of current to the LEDs associated with the display 102. In some implementations, the controller 200 can generate control signals to be sent to the displays 102 based at least in part on the signals it receives from the dimming buttons 104, thereby allowing a user to adjust the brightness of the displays 102 by pressing the buttons 104, as discussed above. In some implementations, the controller 200 may include more or fewer inputs and outputs than are shown in FIG. 2A. For example, in some implementations, the controller 200 also may be configured to receive an input signal from (or to deliver an output signal to) one or both of the USB ports 112*a* and 112*b* shown in FIG. 1A. Similarly, the controller 200 also may be configured to deliver an output signal to one or more audio devices, such as speakers that are used to sound an alarm or play other audio.

Figure 2B:
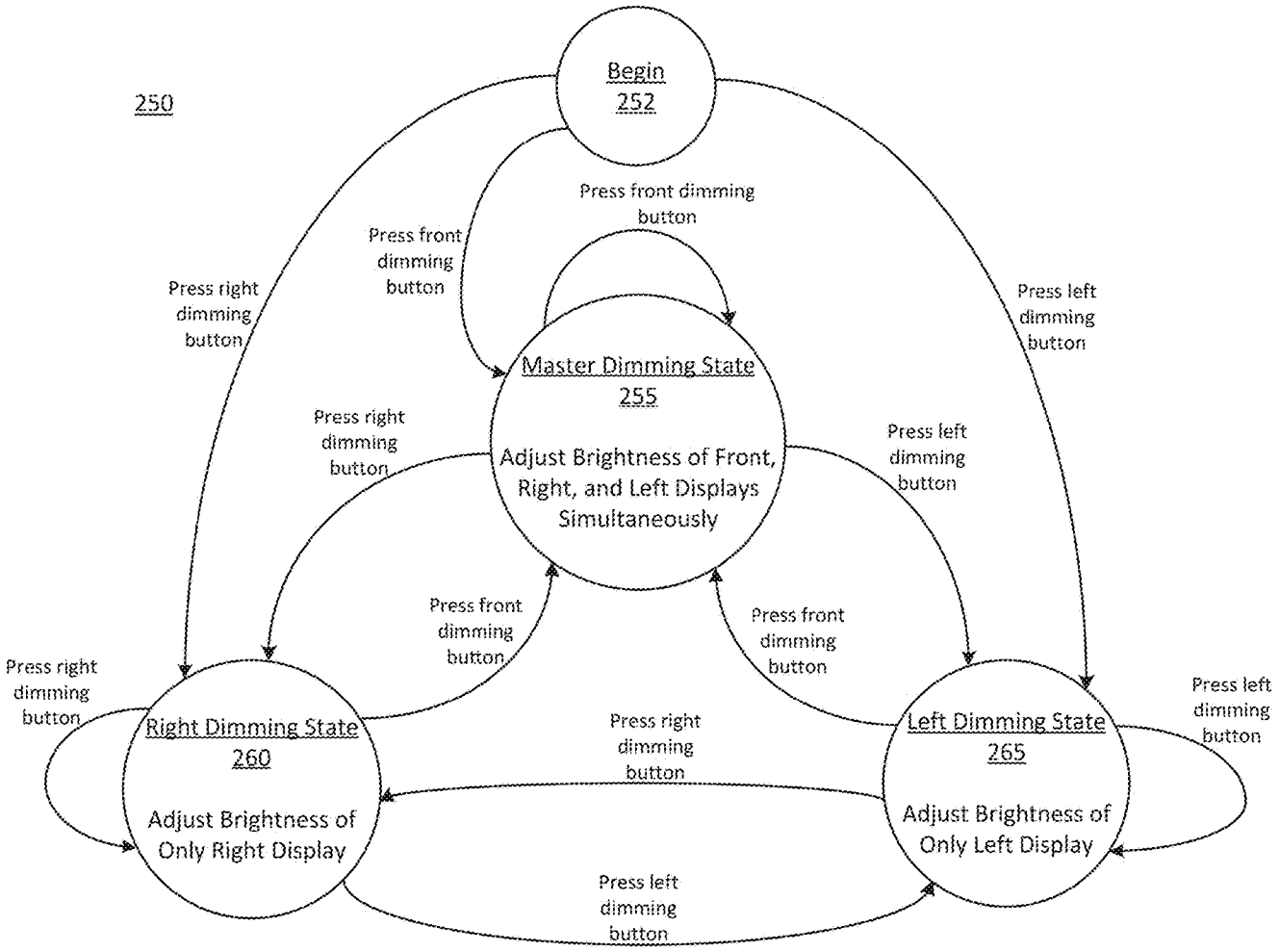
FIG. 2B is a state transition diagram that can be implemented by the controller shown in FIG. 2A, according to an illustrative implementation.

FIG. 2B is a state transition diagram 250 that can be implemented by the controller 200 shown in FIG. 2A, according to an illustrative implementation. As shown, the controller is initialized to the Begin state 252. The controller 200 transitions out of the Begin state 252 in response to detecting that a user has pressed the front dimming button, the right dimming button, or the left dimming button. For example, pressing the front dimming button causes the controller 200 to transition into the Master Dimming State 255. In the Master Dimming State 255, the controller adjusts the brightness of the front display, the right side display, and the left side display simultaneously. For example, as described above, each display can have a predetermined number of brightness levels. When the controller 200 transitions to the Master Dimming State 255, the controller 200 can cause the front display to transition to the next brightness level (e.g., the level that is one level above or below the current brightness level), and can simultaneously cause both the right side display and the left side display to also transition to the same brightness level as the front display. The controller 200 remains in the Master Dimming State 255 until it detects that a user has pressed the front dimming button, the right dimming button, or the left dimming button. If the controller 200 detects that a user has pressed the front dimming button a second time, the controller loops back to the Master Dimming State 255, in which the operations discussed above are repeated. For example, the controller 200 can cause the front display to transition to the next brightness level (e.g., the level that is one level above or below the current brightness level), and can simultaneously cause both the right side display and the left side display to also transition to the same brightness level as the front display. The controller 200 transitions from the Master Dimming State 255 to the Right Dimming State 260 in response to detecting that a user has pressed the right dimming button, and transitions from the Master Dimming State 255 to the Left Dimming State 265 in response to detecting that a user has pressed the left dimming button.

In the Right Dimming State 260, the controller adjusts the brightness of the only the right side display, while the front display and the left side display are maintained at their current brightness levels. For example, in the Right Dimming State 260, the controller 200 can cause the right side display to transition to the next brightness level (e.g., the level that is one level above or below the current brightness level), but does not cause either of the front display or the left side display to change their brightness levels. Thus, a user can adjust the brightness level of the right side display independently of the brightness levels of the front display and the left side display by pressing the right dimming button. The controller 200 remains in the Right Dimming State 260 until it detects that a user has pressed the front dimming button, the right dimming button, or the left dimming button. If the controller 200 detects that a user has pressed the right dimming button a second time, the controller loops back to the Right Dimming State 260, in which the operations discussed above are repeated, by causing the right side display to transition to the next brightness level. The controller 200 transitions from the Right Dimming State 260 to the Master Dimming State 255 in response to detecting that a user has pressed the front dimming button, and transitions from the Right Dimming State 260 to the Left Dimming State 265 in response to detecting that a user has pressed the left dimming button.

In the Left Dimming State 265, the controller adjusts the brightness of the only the left side display, while the front display and the right side display are maintained at their current brightness levels. For example, in the Left Dimming State 265, the controller 200 can cause the left side display to transition to the next brightness level (e.g., the level that is one level above or below the current brightness level), but does not cause either of the front display or the right side display to change their brightness levels. Thus, a user can adjust the brightness level of the left side display independently of the brightness levels of the front display and the right side display by pressing the left dimming button. The controller 200 remains in the Left Dimming State 265 until it detects that a user has pressed the front dimming button, the right dimming button, or the left dimming button. If the controller 200 detects that a user has pressed the left dimming button a second time, the controller loops back to the Left Dimming State 265, in which the operations discussed above are repeated, by causing only the left side display to transition to the next brightness level. The controller 200 transitions from the Left Dimming State 265 to the Master Dimming State 255 in response to detecting that a user has pressed the front dimming button, and transitions from the Left Dimming State 265 to the Right Dimming State 260 in response to detecting that a user has pressed the right dimming button.

It should be understood that the systems described above may provide multiple ones of any or each of those components and these components may be provided on either a standalone machine or, in some embodiments, on multiple machines in a distributed system. The systems and methods described above may be implemented as a method, apparatus or article of manufacture using programming and/or engineering techniques to produce software, firmware, hardware, or any combination thereof. In addition, the systems and methods described above may be provided as one or more computer-readable programs embodied on or in one or more articles of manufacture. The term "article of manufacture" as used herein is intended to encompass code or logic accessible from and embedded in one or more computer-readable devices, firmware, programmable logic, memory devices (e.g., EEPROMs, ROMs, PROMs, RAMs, SRAMs, etc.), hardware (e.g., integrated circuit chip, Field Programmable Gate Array (FPGA), Application Specific Integrated Circuit (ASIC), etc.), electronic devices, a computer readable non-volatile storage unit (e.g., CD-ROM, floppy disk, hard disk drive, etc.). The article of manufacture may be accessible from a file server providing access to the computer-readable programs via a network transmission line, wireless transmission media, signals propagating through space, radio waves, infrared signals, etc. The article of manufacture may be a flash memory card or a magnetic tape. The article of manufacture includes hardware logic as well as software or programmable code embedded in a computer readable medium that is executed by a processor. In general, the computer-readable programs may be implemented in any programming language, such as LISP, PERL, C, C++, C#, PROLOG, or in any byte code language such as JAVA. The software programs may be stored on or in one or more articles of manufacture as object code.

While various embodiments of the methods and systems have been described, these embodiments are exemplary and in no way limit the scope of the described methods or systems. Those having skill in the relevant art can effect changes to form and details of the described methods and systems without departing from the broadest scope of the described methods and systems. Thus, the scope of the methods and systems described herein should not be limited by any of the exemplary embodiments and should be defined in accordance with the accompanying claims and their equivalents.

What is claimed is:

1. A multi-display clock comprising:

a front display on a front face of a housing of a clock to display a time;

a left side display to display the time on a left face of the housing positioned between about 30 degrees to about 120 degrees to the left of an orientation of the front display;

a right side display to display the time on a right face of the housing positioned between about 30 degrees to about 120 degrees to the right of the orientation of the front display;

a front dimming input device configured to receive input to control dimming of each of the front display, the left side display, and the right side display;

a left dimming input device configured to receive input to control dimming of the left side display;

a right dimming input device configured to receive input to control dimming of the right side display; and a controller configured to adjust a brightness level of each of the front display, the left side display, and the right side display, responsive to receiving an input signal from at least one of the front dimming input device, the left dimming input device or the right dimming input device.

2. The multi-display clock of claim 1, wherein:

at least one of the front display, the left side display, and the right side display comprises a light-emitting diode (LED) display; and the controller is further configured to adjust a light output associated with the LEDs of the LED display, responsive to receiving the input signal from the front dimming input device.

3. The multi-display clock of claim 1, wherein:

at least one of the front display, the left side display, and the right side display comprises a liquid crystal display (LCD) and a backlight; and the controller is further configured to adjust a light output associated with the backlight of the LCD, responsive to receiving the input signal from the front dimming input device.

4. The multi-display clock of claim 1, wherein the controller is further configured to:

adjust a brightness level of only the left side display, responsive to receiving an input signal from the left side dimming input device; and adjust a brightness level of only the right side display, responsive to receiving an input signal from the right side dimming input device.

5. The multi-display clock of claim 4, wherein each of the front display, the left side display, and the right side display is configured to display information at a plurality of brightness levels, and wherein the controller is further configured to:

toggle through the brightness levels of the left side display in order from least bright to most bright, responsive to receiving the input signal from the left side dimming input device;

toggle through the brightness levels of the right side display in order from least bright to most bright, responsive to receiving the input signal from the right side dimming input device; and toggle through the brightness levels of the front display, the left side display, and the right side display in order from least bright to most bright, responsive to receiving the input signal from the front dimming input device.

6. The multi-display clock of claim 4, wherein each of the front display, the left side display, and the right side display is configured to display information at a plurality of brightness levels, and wherein the controller is further configured to:

toggle through the brightness levels of the left side display in order from most bright to least bright, responsive to receiving the input signal from the left side dimming input device;

toggle through the brightness levels of the right side display in order from most bright to least bright, responsive to receiving the input signal from the right side dimming input device; and toggle through the brightness levels of the front display, the left side display, and the right side display in order from most bright to least bright, responsive to receiving the input signal from the front dimming input device.

7. The multi-display clock of claim 1, wherein the controller is further configured to:

cause each of the front display, the left side display, and the right side display to display first information; and cause the front display to concurrently display second information along with the first information, wherein the second information is different from the first information.

8. The multi-display clock of claim 7, wherein the first information includes a current time.

9. The multi-display clock of claim 8, wherein the second information includes a time for which an alarm is set, and wherein the controller is further configured to cause the multi-display clock to sound the alarm when the current time matches the time for which the alarm is set.

10. The multi-display clock of claim 9, further comprising an alarm adjust input device configured to receive input to control the time for which the alarm is set, wherein the controller is further configured to adjust the time for which the alarm is set, responsive to receiving an input signal from the alarm adjustment input device.

11. The multi-display clock of claim 1, further comprising at least one universal serial bus (USB) port communicatively coupled to the controller.

12. The multi-display clock of claim 1, wherein the front face of the housing further comprises a substantially transparent cover positioned over the front display.

13. The multi-display clock of claim 1, wherein at least one of the left face of the housing and the right face of the housing includes a substantially opaque portion, and wherein at least one of the left side display and the right side display is configured to be visible through the substantially opaque portion of the housing.

14. A method for using a multi-display clock, comprising:

providing a multi-display clock comprising:

a front display on a front face of a housing of a clock to display a time, a left side display to display the time on a left face of the housing positioned between about 30 degrees to about 120 degrees to the left of an orientation of the front display, a right side display to display the time on a right face of the housing positioned between about 30 degrees to about 120 degrees to the right of the orientation of the front display, a front dimming input device configured to receive input to control dimming of each of the front display, the left side display, and the right side display, a left dimming input device configured to receive input to control dimming of the left side display, and a right dimming input device configured to receive input to control dimming of the right side display;

receiving, by a controller of the multi-display clock, an input signal from one of the front dimming input device, the left dimming input device, or the right input dimming device; and adjusting, by the controller, a brightness level of at least one of the front display, the left side display, or the right side display of the multi-display clock, responsive to receiving the input signal.

15. The method of claim 14, wherein at least one of the front display, the left side display, and the right side display comprises a light-emitting diode (LED) display, the method further comprising adjusting, by the controller, a light output associated with the LEDs of the LED display, responsive to receiving the input signal from the front dimming input device.

16. The method of claim 14, wherein at least one of the front display, the left side display, and the right side display comprises a liquid crystal display (LCD) and a backlight, the method further comprising adjusting, by the controller, a light output associated with the backlight of the LCD, responsive to receiving the input signal from the front dimming input device.

17. The method of claim 14, further comprising:

receiving, by the controller, the input signal from the left side dimming input device; and adjusting, by the controller, a brightness level of only the left side display, responsive to receiving the input signal from the left side dimming input device.

18. The method of claim 14, further comprising:

receiving, by the controller, the input signal from the right side dimming input device; and adjusting, by the controller, a brightness level of only the right side display, responsive to receiving the input signal from the right side dimming input device.

19. The method of claim 14, wherein each of the front display, the left side display, and the right side display is configured to display information at a plurality of brightness levels, the method further comprising:

toggling, by the controller, through the brightness levels of the left side display in order from least bright to most bright, responsive to receiving the input signal from the left side dimming input device;

toggling, by the controller, through the brightness levels of the right side display in order from least bright to most bright, responsive to receiving the input signal from the right side dimming input device; and toggling, by the controller, through the brightness levels of the front display, the left side display, and the right side display in order from least bright to most bright, responsive to receiving the input signal from the front dimming input device.

20. The method of claim 14, wherein each of the front display, the left side display, and the right side display is configured to display information at a plurality of brightness levels, the method further comprising:

toggling, by the controller, through the brightness levels of the left side display in order from most bright to least bright, responsive to receiving the input signal from the left side dimming input device;

toggling, by the controller, through the brightness levels of the right side display in order from most bright to least bright, responsive to receiving the input signal from the right side dimming input device; and toggling, by the controller, through the brightness levels of the front display, the left side display, and the right side display in order from most bright to least bright, responsive to receiving the input signal from the front dimming input device.

21. The method of claim 14, wherein the multi-display clock further comprises an alarm adjustment input device configured to receive input to control a time for which an alarm is set, the method further comprising:

receiving, by the controller, an input signal from the alarm adjustment input device; and adjusting, by the controller, the time for which the alarm is set, responsive to receiving the input signal from the alarm adjustment input device.

* * * * *